United States Patent [19]

Seaman, Jr.

[11] Patent Number: 4,978,469

[45] Date of Patent: Dec. 18, 1990

[54] CLEANING COMPOSITION SUITABLE FOR THE CLEANING OF SUB-FREEZING SURFACES

[75] Inventor: Charles E. Seaman, Jr., Somerset, Wis.

[73] Assignee: Ecolab Inc., St. Paul, Minn.

[21] Appl. No.: 282,878

[22] Filed: Dec. 9, 1988

Related U.S. Application Data

[63] Continuation of Ser. No. 50,623, May 15, 1987, abandoned.

[51] Int. Cl.[5] ..... C11D 7/50

[52] U.S. Cl. ..... 252/170; 252/70; 252/173; 252/174.15; 252/DIG. 1; 252/DIG. 14

[58] Field of Search ..... 252/70, 170, 171, 172, 252/174.15, DIG. 1, DIG. 14, 173; 106/13

[56] References Cited

U.S. PATENT DOCUMENTS

| | | | |
|---|---|---|---|
| 3,115,471 | 12/1963 | Matuska et al. | 252/170 |
| 3,245,912 | 4/1966 | White | 252/70 |
| 3,342,740 | 9/1967 | Kazmierczak et al. | 252/153 |
| 3,463,735 | 8/1969 | Stonebraker et al. | 252/137 |
| 3,835,070 | 9/1974 | Beck | 252/526 |
| 3,839,234 | 10/1974 | Roscoe | 252/544 |
| 3,882,038 | 5/1975 | Clayton et al. | 252/164 |
| 3,955,986 | 5/1976 | Miller | 106/11 |
| 4,077,894 | 3/1978 | Langdon et al. | 252/76 |
| 4,283,297 | 8/1981 | Peters et al. | 252/70 |
| 4,313,841 | 2/1982 | Speigel et al. | 252/170 |
| 4,358,389 | 11/1982 | König-Lumer | 252/70 |
| 4,470,827 | 9/1984 | Kekish et al. | 44/6 |
| 4,676,920 | 6/1987 | Culshaw | 252/163 |

FOREIGN PATENT DOCUMENTS

| | | |
|---|---|---|
| 975605 | 11/1964 | United Kingdom . |
| 1443838 | 7/1976 | United Kingdom . |

OTHER PUBLICATIONS

McCutcheon's, *Functional Materials*, North American Edition, p. 89.

Kirk-Othmer Encyclopedia of Chemical Technology, 2d Ed., vol. 19, pp. 507-590.

*Primary Examiner*—Paul Lieberman

*Assistant Examiner*—Alexander G. Ghyka

*Attorney, Agent, or Firm*—Merchant, Gould, Smith, Edell, Welter & Schmidt

[57] ABSTRACT

A hard surface cleaning composition formulated for cleaning sub-freezing surfaces without solidifying, comprising: about 20-70 wt-% water, about 0.5-20 wt-% nonionic surfactant such as ethoxylated alkyl phenols, about 0.5-15 wt-% alkaline compound such as sodium hydroxide, about 10-60 wt-% ethylene and/or propylene glycol, and about 0.5-20 wt-% of at least one $C_{2-3}$ alcohol.

7 Claims, No Drawings

CLEANING COMPOSITION SUITABLE FOR THE CLEANING OF SUB-FREEZING SURFACES

This is a continuation of application Ser. No. 07/050,623, filed May 15, 1987, now abandoned.

FIELD OF THE INVENTION

The invention relates generally to hard surface cleaning compositions and specifically to hard surface cleaning compositions formulated for cleaning sub-freezing surfaces without solidifying.

BACKGROUND OF THE INVENTION

The cleaning of sub-freezing surfaces such as the interior of a walk-in freezer is a difficult and time consuming task as the typical aqueous based cleaning compositions tend to freeze under such conditions. It is known to use a low freezing point alcohol such as ethanol as a cleaning composition which can overcome this problem but, while effective in preventing freezing of the cleaning composition, it has proven to be an ineffective cleaner.

The most common method of cleaning sub-freezing surfaces such as the interior of a walk-in freezer is to periodically warm up the surfaces to be cleaned to room temperature and then cleaning the room temperature surfaces with any of the typical hard surface aqueous based cleaning compositions. While effective, this method of cleaning sub-freezing surfaces is time consuming, labor intensive and can adversely affect frozen items stored therein.

Accordingly, a substantial need exists for a safe, inexpensive, aqueous based cleaning composition capable of effectively cleaning sub-freezing surfaces.

SUMMARY OF THE INVENTION

I have discovered an inexpensive, aqueous based cleaning composition capable of cleaning sub-freezing surfaces, which comprises: about 20–70 wt-% water, about 0.5–20 wt-% nonionic surfactant, about 0.5–15 wt-% alkaline compound, about 10–60 wt-% ethylene and/or propylene glycol, and about 0.5–20 wt-% of at least one $C_{2-3}$ alcohol. The components may be combined in any order to form the cleaning composition.

The cleaning composition may optionally contain an effective hardness sequestering amount of a hardness sequestrant and/or an effective defoaming amount of a silicone based defoamer.

Sub-freezing surfaces may be cleaned with the composition without the need to warm up the surface by simply scrubbing the sub-freezing surface with a cleaning amount of the cleaning composition and then removing the soil-containing composition from the surface.

DETAILED DESCRIPTION OF THE INVENTION

A major portion of the cleaning composition comprises a mixture of the cosolvents, water, a $C_{2-3}$ glycol and a $C_{2-3}$ alcohol. The water/glycol/alcohol combination creates a system having a freezing point well below that of water alone, while retaining many of the attributes of an aqueous based system such as low cost, safety and ease of use. The cleaning composition contains about 20–70 wt-% water, about 10–60 wt-% glycol, and about 0.5–20 wt-% alcohol at a ratio of about 1 part water to 0.5 to 4 parts glycol to 0.1 to 1 part alcohol.

When the cleaning composition is intended for use around consumable goods, it is preferred to use propylene glycol as the glycol and isopropanol as the alcohol in light of their nontoxic nature.

The freezing point of the cleaning composition may be varied by adjusting the ratio between water, glycol and alcohol. As an aid to estimating the ratio necessary to achieve a desired freezing point the freezing points for various two-component mixtures of water and either ethanol, isopropanol, ethylene glycol or propylene glycol are provided in Tables 1–4.

TABLE 1

| Ethyl Alcohol-Water Mixtures | | | |
|---|---|---|---|
| % Alcohol By Weight | % Alcohol By Volume | Freezing Point °C. | Freezing Point °F. |
| 2.5 | 3.13 | −1.0 | 30.2 |
| 4.8 | 6.00 | −2.0 | 28.4 |
| 6.8 | 8.47 | −3.0 | 26.6 |
| 11.3 | 14.0 | −5.0 | 23.0 |
| 13.8 | 17.0 | −6.1 | 21.0 |
| 16.4 | 20.2 | −7.5 | 18.5 |
| 17.5 | 21.5 | −8.7 | 16.3 |
| 18.8 | 23.1 | −9.4 | 15.1 |
| 20.3 | 24.8 | −10.6 | 12.9 |
| 22.1 | 27.0 | −12.2 | 10.0 |
| 24.2 | 29.5 | −14.0 | 6.8 |
| 26.7 | 32.4 | −16.0 | 3.2 |
| 29.9 | 36.1 | −18.9 | −2.0 |
| 33.8 | 40.5 | −23.6 | −10.5 |
| 39.0 | 46.3 | −28.7 | −19.7 |
| 46.3 | 53.8 | −33.9 | −29.0 |
| 56.1 | 63.6 | −41.0 | −41.8 |
| 71.9 | 78.2 | −51.3 | −60.3 |

TABLE 2

| Prestone-Water Mixtures* | | | |
|---|---|---|---|
| % Prestone By Weight | % Prestone By Volume | Freezing Point °C. | Freezing Point °F. |
| 10 | 9.2 | −3.6 | 25.6 |
| 15 | 13.8 | −5.6 | 22.0 |
| 20 | 18.3 | −7.9 | 17.8 |
| 25 | 23.0 | −10.7 | 12.8 |
| 30 | 28.0 | −14.0 | 6.8 |
| 40 | 37.8 | −22.3 | −8.2 |
| 50 | 47.8 | −33.8 | −28.8 |
| 60 | 58.1 | −49.3 | −56.7 |

*Eveready Prestone (manufactured by the National Carbon Co.), marketed for antifreeze purposes, is 97% ethylene glycol containing fractional percentages of soluble and insoluble ingredients to prevent foaming, creepage and water corrosion in automobile cooling systems.

TABLE 3

| Iso-Propyl Alcohol-Water Mixtures | | |
|---|---|---|
| % Alcohol By Volume | Freezing Point °C. | Freezing Point °F. |
| 5 | −1.7 | 29 |
| 10 | −3.3 | 26 |
| 15 | −6.1 | 21 |
| 20 | −8.3 | 17 |
| 25 | −11.1 | 12 |
| 30 | −14.4 | 6 |
| 35 | −17.8 | 0 |
| 40 | −18.3 | −1 |
| 45 | −18.9 | −2 |
| 50 | −20.0 | −4 |
| 55 | −21.7 | −7 |
| 60 | −23.3 | −10 |
| 65 | −24.4 | −12 |
| 70 | −26.7 | −16 |
| 75 | −32.2 | −26 |

TABLE 3-continued

| Iso-Propyl Alcohol-Water Mixtures | | |
|---|---|---|
| % Alcohol | Freezing Point | |
| By Volume | °C. | °F. |
| 80 | −41.7 | −43 |

TABLE 4

| Propylene Glycol-Water Mixtures | | |
|---|---|---|
| % Glycol | Freezing Point | |
| By Weight | °C. | °F. |
| 5 | −1.1 | 30 |
| 10 | −2.2 | 28 |
| 15 | −3.9 | 25 |
| 20 | −6.7 | 20 |
| 25 | −8.9 | 16 |
| 30 | −12.8 | 9 |
| 35 | −16.1 | 3 |
| 40 | −20.6 | −5 |
| 45 | −26.7 | −16 |
| 50 | −33.3 | −28 |

To achieve a cost effective cleaning composition useful in substantially all situations, it is preferred to employ a water/glycol/alcohol ratio of about 1.3/1/0.2 to 1/1/0.5.

In addition to acting as a freezing point depressant the alcohol also acts to dissolve and suspend certain soils such as animal fats and oils and food particles.

To enhance the cleaning efficiency of the composition, about 0.5–20 wt-% of a nonionic surfactant and about 0.5–15 wt-% of an alkaline compound may be added to the cosolvents.

Surfactants are a well known group of compounds having contrasting hydrophilic and hydrophobic portions which allow the compound to significantly reduce surface tension between a surface and an aqueous solvent in which the surfactant is dissolved. Nonionic surfactants are those surfactants which bear essentially no charge when dissolved or dispersed in water. While substantially any nonionic surfactant may be usefully employed in the present composition, those types typically employed in cleaning compositions include polyoxyethylenes, ethoxylated alkyl phenols, ethoxylated aliphatic alcohols, and polyalkylene oxide block copolymers. For reasons of low cost, ease of availability and effective surfactant properties, the preferred nonionic surfactants for use in the present invention are the ethoxylated alkyl phenols and the ethoxylated aliphatic alcohols. Most preferred are the $C_{8-10}$ alkyl phenols having 6 to 10 ethylene oxide units, and the $C_{8-15}$ aliphatic alcohols having 7 to 12 ethoxide units.

The manufacture of ethoxylated nonionic surfactants is well known as evidenced by the detailed disclosure of the manufacture and use of nonionic surfactants found in the *Kirk-Othmer, Encyclopedia of Chemical Technology,* 2d Ed., Vol 19, pp. 507–590.

Alkaline compounds useful in the present invention include any of those alkaline compounds typically employed in cleaning compositions including sodium and potassium hydroxide, monoethanolamine (MEA), diethanolamine (DEA), triethanolamine (TEA), sodium and potassium bicarbonate, sodium and potassium sequicarbonate, sodium and potassium carbonate, sodium and potassium borate, etc. Because of their low cost, ease of availability and effective cleaning characteristics the preferred alkaline compounds for use in the present composition are the alkali metal hydroxides, MEA and TEA.

An effective hardness sequestering amount of a hardness sequestrant may optionally be added to the composition to remove Ca, Mg and Fe ions from the cleaning media and thereby to improve the cleaning effectiveness of the surfactant. Any of the commonly known sequestering agents such as aminopolycarboxylic acids, alpha-hydroxy acids and condensed phosphates may be incorporated into the composition. Because of their solubility and low cost, the preferred sequestering agents are the amino polycarboxylic acids such as NTA and EDTA and the hydroxy acids such as citric and tartaric acids.

An effective defoaming amount of a silicone based defoamer may optionally be added to the composition to simplify removal of the composition from the subfreezing surface. Any of the well known silicone based defoamers may be utilized in the present invention including SAG 10, SAG 710, etc., (silicone defoamer sold by Union Carbide). Because of its clearance as a food grade material, the preferred silicone defoamer is SAG 710 Silicone Emulsion.

The cleaning composition may be manufactured by blending the individual components in any desired manner. It is, however, preferable to add the alkaline compound to the water rather than vice versa so that any heat generated by hydration of the alkaline compound may be dispersed throughout the water to prevent splattering.

The cleaning composition may optionally contain other components commonly found in liquid cleaning compositions such as a fragrance, a dye, etc.

The formulation of two typical examples of my cleaning composition are presented below to aid in a complete nonlimiting understanding of my invention.

| Example I | | Example II | |
|---|---|---|---|
| Component | Wt-% | Component | Wt-% |
| Water | 48 | Water | 43 |
| MEA | 3 | TEA | 5 |
| IPA | 7.5 | EDTA | 5 |
| NPE 9.5[1] | 1.5 | IPA | 5 |
| SAG 710[2] | 0.002 | SAG 710 | 0.002 |
| Propylene Glycol | 40 | Propylene Glycol | 40 |
| Dye | 0.0006 | Dye | 0.0006 |

[1]Nonylphenol ethoxylate containing an average of 9.5 ethoxy units.
[2]A silicone defoamer sold by Union Carbide.

The formulation of Example I is designed to clean walk-in freezers or food storage areas maintained at about −25° to −15° F. (−32° to −26° C.) without warming or defrosting of the freezer or food storage area. The composition is applied to the surface by a means such as a mop, a sponge, a spray mechanism, etc. The composition is spread evenly over the surface to aid in soil removal. The composition is then allowed to remain in contact with the surface for a time necessary to loosen frozen soil and ice deposits which is typically between 2 to 20 minutes. For optimum results the cleaning composition is preferably left in contact with the frozen surface for about 5 to 10 minutes. The cleaning solution is then removed from the surface by means of a mop, sponge, a vacuum, etc.

The formulation of Example II is designed to clean subfreezing areas that have accumulated soil deposits and mineral deposits. Such areas include but are not limited to freezers, meat lockers, cold storage warehouses, etc. The method of application and contact time are substantially similar to that outlined with respect to the formulation of Example I.

The specification and Examples above are presented to aid in the complete nonlimiting understanding of the invention. Since many variations and embodiments of the invention can be made without departing from the spirit and scope of the invention, the invention resides in the claims hereinafter appended.

We claim:

1. A method of cleaning sub-freezing surfaces, which comprises the steps of:

(a) applying to the surface a cleansing amount of a cleaning composition, wherein the cleansing composition does not freeze after application to the surface, wherein the cleansing composition comprises:

(i) about 20–70 wt-% water;

(ii) about 0.5–20 wt-% nonionic surfactant;

(iii) about 0.5–15 wt-% alkaline compound;

(iv) about 10–60 wt-% ethylene glycol, propylene glycol or mixtures thereof;

(v) about 0.5–20 wt-% ethanol, propanol, isopropanol or mixtures thereof;

(vi) about 0–10 wt-% hardness sequestrant;

(vii) about 0–1 wt-% silicone based defoamer; and (viii) about 0–1 wt-% dye; and then (b) removing the cleaning composition from the surface.

2. A method of cleaning sub-freezing surfaces, which comprises the steps of:

(a) applying to the surface a cleansing amounts of a cleaning composition, wherein the cleaning composition does not freeze after application to the surface, wherein the cleansing composition comprises:

(i) about 20–60 wt-% water;

(ii) about 2–10 wt-% nonionic surfactant;

(iii) about 1–10 wt-% alkaline compound;

(iv) about 30–50 wt-% ethylene glycol, propylene glycol or mixtures thereof;

(v) about 2–20 wt-% ethanol, propanol, isopropanol or mixtures thereof;

(vi) about 0–10 wt-% hardness sequestrant;

(vii) about 0–1 wt-% silicone based defoamer and (viii) about 0–1 wt-% dye; and then (b) removing the cleaning composition from surface.

3. A method of cleaning sub-freezing surfaces, which comprises the steps of:

(a) applying to the surface with a cleansing amount of a cleaning composition, wherein the cleaning composition does not freeze after application to the surface, where in the cleaning composition comprises:

(i) about 40–60 wt-% water;

(ii) about 2–10 wt-% surfactant selected from the group consisting of ethoxylated alkylphenols and ethoxylated aliphatic alcohols;

(iii) about 1–10 wt-% alkaline compound selected from the group consisting of alkali metal hydroxides, monoethanolamine, diethanolamine and triethanolamine;

(iv) about 30–50 wt-% propylene glycol;

(v) about 2–20 wt-% isopropanol;

(vi) about 0–10 wt-% hardness sequestrant selected from the group consisting of aminopolycarboxylic acid and α-hydroxy acids;

(vii) about 0–1 wt-% silicon-based defoamer; and (viii) about 0–1 wt-% dye; and then (b) removing the cleaning composition from the surface.

4. The method of claim 1 wherein the temperature of the surface is between about −20 to −3° C.

5. The method of claim 1 wherein the silicone based defoamer is present at about 0.002 to 1 wt-%.

6. The method of claim 2 wherein the silicone based defoamer is present at about 0.002 to 1 wt-%.

7. The method of claim 3 wherein the silicone based defoamer is present at about 0.002 to 1 wt-%.

* * * * *